US007412881B2

(12) United States Patent
Crawley et al.

(10) Patent No.: US 7,412,881 B2
(45) Date of Patent: Aug. 19, 2008

(54) FLUID FLOWRATE DETERMINATION

(75) Inventors: Charles Milton Crawley, Sugar Land, TX (US); Steve M. Moca, Pleasanton, CA (US); Roy Lester Kutlik, Oakland, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 191 days.

(21) Appl. No.: 11/496,322

(22) Filed: Jul. 31, 2006

(65) Prior Publication Data

US 2008/0023196 A1 Jan. 31, 2008

(51) Int. Cl.
*G01F 1/68* (2006.01)
*E21B 47/10* (2006.01)

(52) U.S. Cl. ..... 73/204.11; 73/152.33

(58) Field of Classification Search ..... 73/152.18, 73/152.33, 204.11, 204.16, 204.17, 204.13
See application file for complete search history.

(56) References Cited

U.S. PATENT DOCUMENTS 4,520,666 A * 6/1985 Coblentz et al. ..... 73/152.33
5,014,553 A * 5/1991 Hori et al. ..... 73/295
5,417,110 A * 5/1995 Wood ..... 73/204.16
5,645,348 A * 7/1997 Stulen et al. ..... 374/45
5,836,693 A * 11/1998 Stulen et al. ..... 374/45
5,980,102 A * 11/1999 Stulen et al. ..... 374/45
6,085,588 A * 7/2000 Khadkikar et al. ..... 73/204.27
6,618,677 B1 9/2003 Brown
6,769,805 B2 8/2004 Williams et al.
6,807,324 B2 * 10/2004 Pruett ..... 385/12
2005/0149264 A1 7/2005 Tarvin et al.

* cited by examiner

*Primary Examiner*—Hezron E. Williams
*Assistant Examiner*—John Fitzgerald
(74) *Attorney, Agent, or Firm*—Steven L. Christian

(57) ABSTRACT

A method and apparatus are useful for determining the flowrate of fluid flowing within a passage. The method comprises the step of measuring the equilibrium temperature of a location of interest within or proximate to the passage within which fluid flows. The temperature of the location of interest is perturbed to a second temperature, and the temperature of the location of interest is then allowed to return to its equilibrium temperature. The temperature of the location of interest is monitored as it transitions between the second temperature and the equilibrium temperature. The monitored temperature transition is then used to determine the flowrate of the fluid flowing within the passage.

22 Claims, 6 Drawing Sheets

FLUID FLOWRATE DETERMINATION

BACKGROUND OF THE INVENTION

1. Field of the Invention

The present invention relates to fluid flowrate determination, and more particularly to the determination of flowrates for hydrocarbons flowing through one or more portions of a producing wellbore. The invention has particular application in horizontal wellbores and in wellbores having multiple producing zones.

2. Background of the Related Art

Flowrate determination, particularly mass flowrate determination, is an important function in the efficient management of hydrocarbon production from producing subsurface formations (also known as reservoirs). Real time or near-real time flowrate determination is particularly valuable in the diagnosis and remediation of production problems. The overall mass flowrate through conventional, producing wellbores can easily be determined at the wellhead using known methods. Obtaining a more detailed understanding of the flow from various downhole portions of a wellbore, however, is more difficult and requires making measurements within the wellbore itself. Prior methods for determining fluid flowrates downhole, particularly in multiple producing zones and in horizontal wellbore segments, have not been entirely satisfactory.

U.S. Pat. No. 5,610,331, to Western Atlas, describes a method for determining a flow regime of fluids in a conduit. The method generates a temperature map of the conduit through the use of a plurality of distributed temperature sensors and a means for determining the position of each one of the sensors within the cross-section of the conduit. A flow regime is determined by comparing the temperature map with a map generated from laboratory experiments in a flow loop. The system of the '331 patent is limited by its requirement for a distributed temperature profile, including a plurality of temperature indications along a wellbore.

U.S. Pat. No. 6,618,677 to Sensor Highway describes a fiber optic sensor system for determining the mass flowrates of produced fluid within a conduit disposed in a wellbore. According to the specification, fluid produced through the wellbore conduit (production tubing) generally exhibits a relatively high temperature. The subsurface formation(s) that the wellbore extends through are generally at a lower temperature than the reservoir from which the produced fluid originated. As the produced fluid passes upwardly through the wellbore conduit past the cooler, surrounding subsurface formation(s), the fluid is said to cool. A fiber optic sensor system is employed to monitor this cooling over a length of the conduit and to generate a distributed temperature profile. The generated distributed temperature profile is compared with a previously-determined temperature-flowrate calibration to determine a mass flowrate of fluids within the wellbore conduit. The system of the '677 patent is therefore also limited by a need to acquire measurements at a plurality of locations along the length of the wellbore conduit.

U.S. Pat. No. 6,769,805, also to Sensor Highway, describes a method of using a heater cable equipped with a fiber optic distributed temperature sensor to determine fluid flowrate within a wellbore. The cable is heated to a temperature above the temperature of the wellbore in which it is positioned, and then de-energized so as to cool under the flow of produced fluid through the wellbore. The fiber optic distributed temperature sensor is employed to generate a distributed temperature profile along the heater cable. The '805 patent suggests that the generated profile may be correlated to the fluid flowrate, within explaining how to achieve this. U.S. Pat. No. 6,920,395, also to Sensor Highway, is similar to the '805 patent except it employs a heat sink (rather than temporary, active heating) to induce cooling of a fiber optic distributed temperature sensor. The systems of the '395, '805, '677 and '331 patents are therefore all limited to flowrate correlations based upon distributed temperature profiles.

U.S. Pat. No. 6,766,854 to Schlumberger describes a system for obtaining downhole data from a subsurface formation penetrated by a wellbore bore, and is characterized by the use of a sensor plug positioned in the sidewall of a wellbore, and separate downhole tools for installing and communicating with the plug. The system of the '854 patent is limited by the permanent nature of the sensor plug and the complexity of installing and establishing communication with it, possibly across a casing wall.

U.S. Pat. No. 6,817,257 to Sensor Dynamics describes an apparatus and a method for remote measurement of physical parameters involving an optical fiber cable sensor and a cable installation mechanism for installing the optical fiber cable within a specially-configured conduit. The installation mechanism includes a means for propelling a fluid along the conduit so as to deploy the optical fiber cable sensor, and a seal assembly between the optical fiber cable and the conduit. The '257 patent mentions that its "sensor" can be a flow sensor "based on combining the outputs from more than one sensor and applying an algorithm to estimate flow" but does not explain how this may be achieved.

The flowrate-determining solutions mentioned above are therefore characterized by systems requiring the development of a distributed temperature profile over a length of the wellbore, and systems requiring permanent installation and potentially difficult communication with downhole sensors. A need therefore exists for a flowrate-determining solution that is adaptable to being used in a multitude of downhole locations, not restricted by the need for a distributed sensing length.

A need further exists for a flowrate-determining solution that facilitates easy installation—temporary or permanent—but is not encumbered by a need for permanent installation. Adaptability in the installation of a flowrate-determining solution will facilitate its application in wellbores having multiple producing zones as well as horizontal wellbore sections, including horizontal "legs" of so-called multilateral wellbores. Horizontal wellbore bore sections are typically fluidly-connected to a vertical wellbore section that extends to the surface. By way of example, it is of considerable interest to a drilling engineer (in the case of wellbore drilling) or a production/reservoir engineer (in the case of wellbore production) whether a portion of the horizontal wellbore section near the vertical section is producing at a much higher volumetric flowrate, at about the same rate, or at a much lower rate, than a portion of the horizontal wellbore section that is far from the vertical wellbore section.

DEFINITIONS

Certain terms are defined throughout this description as they are first used, while certain other terms used in this description are defined below:

"Cold sink" means an environment or object capable of transferring heat to another object with which it is in thermal contact (either physical contact or radiational "contact").

"Conduit" means a natural or artificial channel through which something—particularly a fluid—is conveyed.

"Equilibrium temperature" means a balanced temperature condition, based upon present operating conditions, that remains constant under no external stimulus over a monitoring period of interest.

"Heat sink" means an environment or object capable of absorbing heat from another object with which it is in thermal contact (either physical contact or radiational "contact").

"Passage" means a path, channel, or course by which something—particularly a fluid—passes.

SUMMARY OF THE INVENTION

In one aspect, the present invention provides a method for determining the flowrate of fluid flowing within a passage. The method comprises the step of measuring the equilibrium temperature of a location of interest within or proximate to the passage within which fluid flows. The temperature of the location of interest is perturbed to a second temperature, and the temperature of the location of interest is then allowed to return to its equilibrium temperature. The temperature of the location of interest is monitored as it transitions between the second temperature and the equilibrium temperature. The monitored temperature transition is then used to determine the flowrate of the fluid flowing within the passage.

In particular embodiments of the inventive method, a temperature sensor is positioned at the location of interest for performing the measuring and monitoring steps. The temperature sensor may comprise an optical fiber.

In particular embodiments, the passage within which fluid flows is defined by a wellbore penetrating one or more subsurface earth strata. The fluid in such a passage may comprise at least one of oil, gas, water, and a combination thereof. The passage may be further defined by a conduit disposed in the wellbore, for example, by a conduit disposed in a portion of the wellbore that is substantially horizontal.

The perturbing step according to the inventive method may be performed using a temperature sink, such as a heat sink or a cold sink. The temperature sink may be substantially collocated with the temperature sensor.

In particular embodiments of the inventive method, the using step comprises correlating the monitored temperature transition to flowrate within the passage. The time required for the temperature of the location of interest to transition halfway between the second temperature and the equilibrium temperature defines a temperature relaxation half-life that may be correlated to flowrate within the passage. The correlation between temperature relaxation half-life and flowrate within the passage may be substantially linear.

In another aspect, the present invention provides an apparatus for determining the flowrate of hydrocarbon fluids flowing within a portion of a wellbore penetrating a subsurface stratum of interest. The inventive apparatus comprises a means including at least a temperature sink positionable at or near a location of interest within the wellbore for perturbing the temperature of the location of interest, and a temperature sensor positionable at or near the location of interest.

In particular embodiments of the inventive method, the temperature-perturbing means is controllable from a surface location to perturb the temperature of the location of interest to a temperature other than the equilibrium temperature at the location of interest.

The temperature sink according to the inventive apparatus may comprise a heat sink or a cold sink. Accordingly, the temperature-perturbing means may comprise a conduit through which a cooling medium or a heating medium is transmitted, respectively. The temperature sink and the temperature sensor may be integrated within a single unit, or may be installed separately within the wellbore bore.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
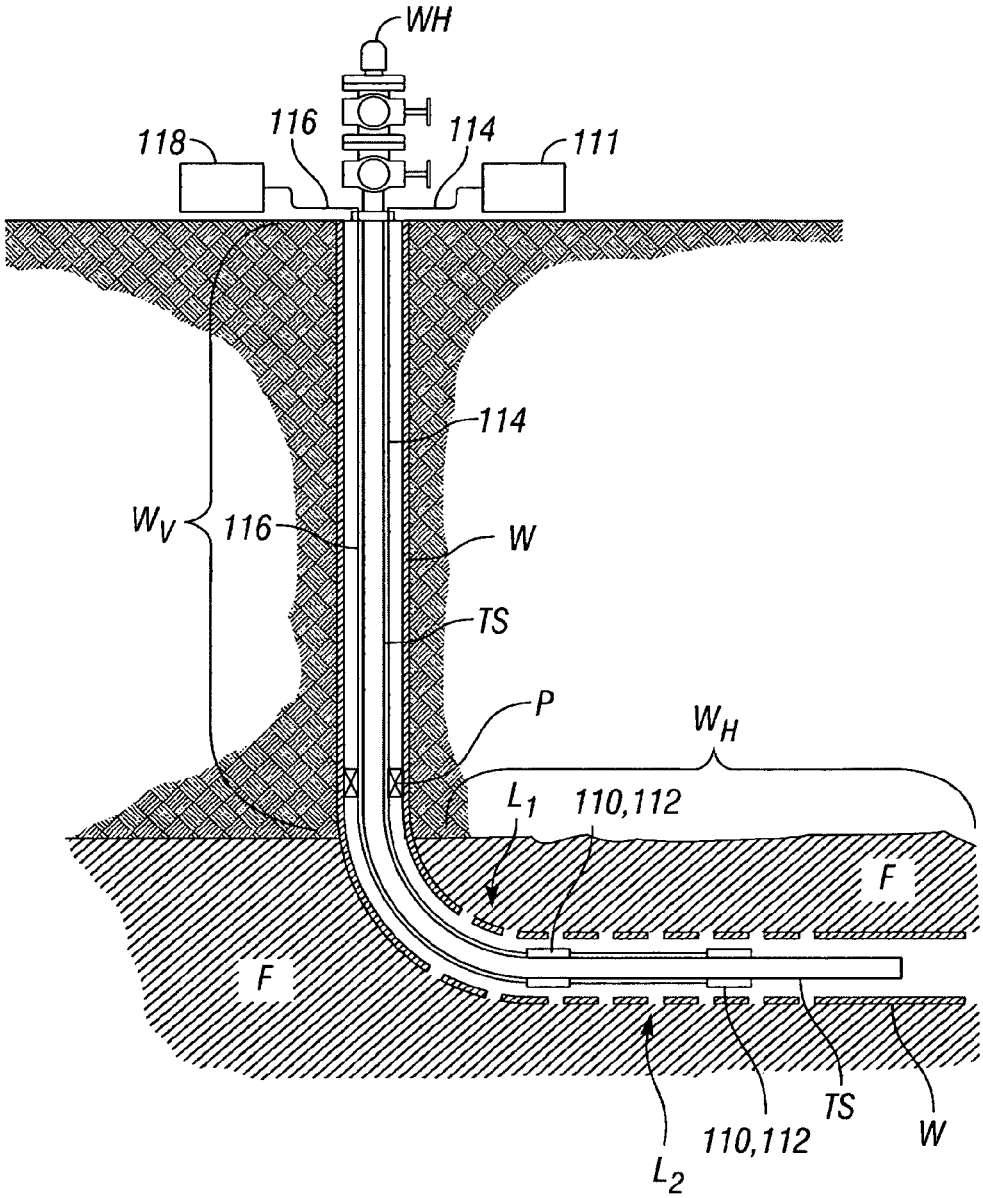
FIG. 1 is a sectional schematic representation of a wellbore having a horizontal section that penetrates a producing formation, with the wellbore having a production tubing string therein that employs a temperature-perturbing means and a temperature sensor according to the present invention.

FIG. 1 is a sectional schematic representation of one embodiment of the present invention for determining the mass flowrate of a fluid produced from a subsurface formation F and flowing upwardly through a production tubing string TS disposed in a wellbore W and terminating at a wellhead WH. The wellbore W is characterized by a substantially vertical section $W_V$ and at least one substantially horizontal section $W_H$ that penetrates a producing formation F, with the horizontal section $W_H$ being isolated from the vertical section $W_V$ by a packer assembly P.

As embodied in FIG. 1, an apparatus according to the present invention comprises a means (collectively referenced as 110, 111, 114) for perturbing the temperature of one or more locations $L_1$, $L_2$ of interest within the horizontal section $W_H$ of the wellbore W. The temperature perturbing means includes one or more temperature sinks 110 carried on the tubing string TS so as to be positionable at or near the respective locations of interest $L_1$, $L_2$. The temperature sink(s) (described in greater detail below in reference to FIG. 3) may comprise various applications of a heat sink or a cold sink (e.g., an adaptive heat exchanger), so as to induce a temperature perturbation at the respective locations of interest $L_1$, $L_2$.

In the embodiment of FIG. 1, the temperature-perturbing means is controllable from a surface system 111 that generates and controls the transmission of a cooling medium or a heating medium to the temperature sinks 110 so as to perturb the temperature of the respective locations of interest $L_1$, $L_2$ to a temperature other than the equilibrium temperature at the locations of interest. The temperature-perturbing means illustrated in FIG. 1 further comprises a conduit 114 through which the cooling medium or heating medium from the surface system 111 is transmitted to the temperatures sinks 110. Such a transmission conduit 114 may include two parallel branches in the shape of a U-tube, beginning and ending at the surface system 111. Accordingly, the surface system 111 is operable to transmit, as appropriate, either a cooling or heating medium (e.g., a gas or other fluid, or even electrical current in the case of heating) through the transmission conduit 114 to the temperature sinks 110, causing perturbation of the local temperatures at the respective locations of interest $L_1$, $L_2$ for a temporary period of time, after which the temperature perturbation is removed (as described further below).

The inventive apparatus embodied in FIG. 1 further comprises one or more temperature sensors 112 positionable at or near the locations of interest $L_1$, $L_2$. The temperature sensors 112 are connected for communication with surface control and recording electronics 118 by way of a communication link 116. The communication link 116 can take various forms, including a wired link and a wireless link, with the latter possibly including one or more of the following: a satellite connection, a radio connection, a connection through a main central router, a modem connection, a web-based or internet connection, a temporary connection, and/or a connection to a remote location such as the offices of an operator. The communication link 116 may enable real time or near-real time transmission of data or may enable time-lapsed transmission of data, as is required to permit a user to monitor the wellbore conditions and take necessary remedial action based on a diagnosis. The temperature sensors 112 may constitute a number of various sensor types that are known to those having ordinary skill in the art, such as resistance temperature detectors (RTDs) or thermocouple-based sensors, as well as fiber optic-based sensors.

In the case of fiber optic-based sensors, the communication link 116 constitutes a string of optical fibers and the surface electronics 118 constitutes an opto-electronic unit (including a light source and a light detector) and an appropriate processor/recorder as are known to those skilled in the art. Unlike the previously-known fiber optic applications (mentioned above) that relied on distributed temperature sensing, the sensors according to the present invention are adapted for a localized temperature determination at the locations of interest $L_1$, $L_2$. As is also known to those skilled in the art, in an optical fiber-based sensor solution the optical fibers may be routed between the surface electronics 118 and the sensor 112 via an appropriate conduit that may be attached to the tubing string TS via clamps or the like, and that constitutes part of the communication link 116. Such a routing conduit may include two parallel branches in the shape of a U-tube, beginning and ending at the surface electronics 118. Accordingly, the surface electronics 118 are operable to transmit optical pulses through the optical fibers in the communication link 116 to the fiber optic-based sensors 112, causing backscattered light signals to be returned from the sensors 112 that contains information representing the temperatures of both of the respective sensors 112.

In the embodiment of FIG. 1, the temperature sinks 110 and the temperature sensors 112 are shown as integrated within a single unit. It will be appreciated by those having ordinary skill in the art, however, that the temperature sensor(s) may be installed separately from the temperature sink(s) within the wellbore.

Figure 2:
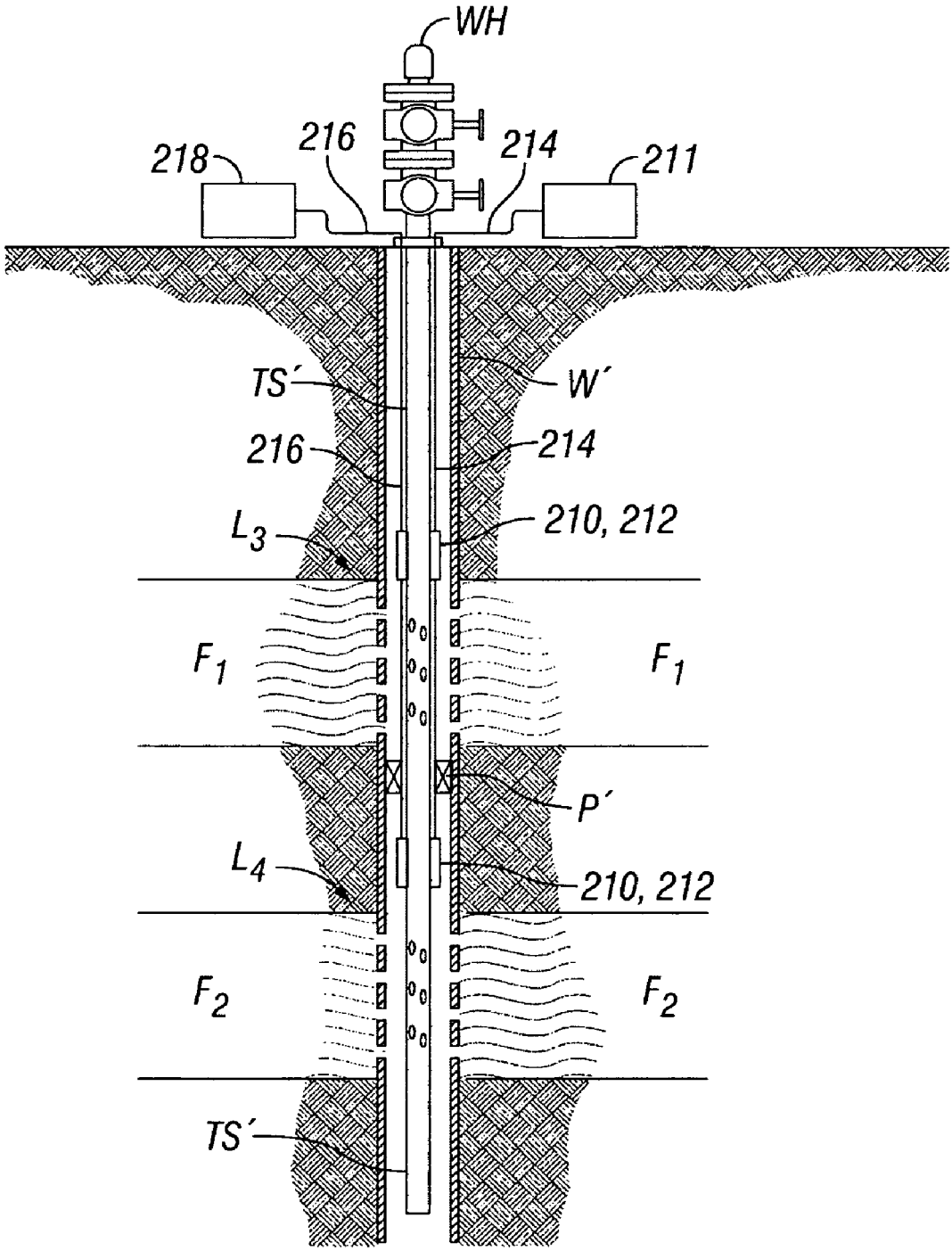
FIG. 2 is a sectional schematic representation of a wellbore having a vertical section that penetrates two producing formations or zones, with the wellbore having a production tubing string therein that employs a temperature-perturbing means and a temperature sensor according to the present invention.

FIG. 2 is a sectional schematic representation of another embodiment of the present invention for determining the mass flowrate of a fluid produced through a production tubing string TS' disposed in a wellbore W' and terminating at a wellhead WH. The wellbore W' is substantially vertical and penetrates a pair of producing zones or formations $F_1$, $F_2$, isolated from one another by a packer assembly P'.

As embodied in FIG. 2, an apparatus according to the present invention comprises a means (collectively referenced as 210, 211, 214) for perturbing the temperature of one or more locations $L_3$ $L_4$ of interest within the respective formations $F_1$, $F_2$ penetrated by the vertical wellbore W'. The temperature perturbing means includes one or more temperature sinks 210 carried on the tubing string TS' so as to be positionable at or near the respective locations of interest $L_3$, $L_4$. As with the temperature sink(s) 110 described above, the temperature sinks 210 may comprise various applications of a heat sink or a cold sink (e.g., an adaptive heat exchanger), so as to induce a temperature perturbation at the respective locations of interest $L_3$, $L_4$.

In the embodiment of FIG. 2, the temperature-perturbing means is controllable from a surface system 211 that generates and controls the transmission of a cooling medium or a heating medium to the temperature sinks 210 so as to perturb the temperature of the respective locations of interest $L_3$, $L_4$ to a temperature other than the equilibrium temperature at the locations of interest. The temperature-perturbing means illustrated in FIG. 2 further comprises a conduit 214 through which the cooling medium or heating medium from the system 211 is transmitted to the temperatures sinks 210. Such a transmission conduit 214 may include two parallel branches in the shape of a U-tube, beginning and ending at the surface system 211. Accordingly, the surface system 211 is operable to transmit, as appropriate, either a cooling or heating medium (e.g., a gas or other fluid, or even electrical current in the case of heating) through the transmission conduit 214 to the temperature sinks 210, causing perturbation of the local temperatures at the respective locations of interest $L_3$, $L_4$ for a temporary period of time, after which the temperature perturbation is removed (as described further below).

The inventive apparatus embodied in FIG. 2 further comprises one or more temperature sensors 212 positionable at or near the locations of interest $L_3$, $L_4$. The temperature sensors 212 are connected for communication with surface control and recording electronics 218 by way of a communication link 216. As with communication link 116 described above, the communication link 216 can take various forms, including a wired link and a wireless link. The temperature sensors 212 may constitute a number of various sensor types that are known to those having ordinary skill in the art, such as RTD or thermocouple-based sensors, as well as fiber optic-based sensors.

In the case of fiber optic-based sensors, the communication link 216 constitutes a string of optical fibers and the surface electronics 218 constitutes an opto-electronic unit (including a light source and a light detector) and an appropriate processor/recorder as are known to those skilled in the art. Unlike the previously-known fiber optic applications (described above) that focused on distributed temperature sensing, the sensor 212 according to the present invention is adapted for a localized temperature determination at the locations of interest $L_3$, $L_4$. As is also known to those skilled in the art, the optical fibers may be routed between the surface electronics 218 and the sensor 212 via an appropriate conduit that may be attached to the tubing string TS' via clamps or the like, and that constitutes part of the communication link 216. Such a routing conduit may include two parallel branches in the shape of a U-tube, beginning and ending at the surface electronics 218. Accordingly, the surface electronics 218 are operable to transmit optical pulses through the optical fibers in the communication link 216 to the fiber optic-based sensors 212, causing backscattered light signals to be returned from the sensors 212 that contains information representing the temperatures of both of the respective sensors 212.

In the embodiment of FIG. 2, the temperature sinks 210 and the temperature sensors 212 are shown as integrated within a single unit. It will be appreciated by those having ordinary skill in the art, however, that the temperature sensor(s) may be installed separately from the temperature sink(s) within the wellbore.

Figure 3:
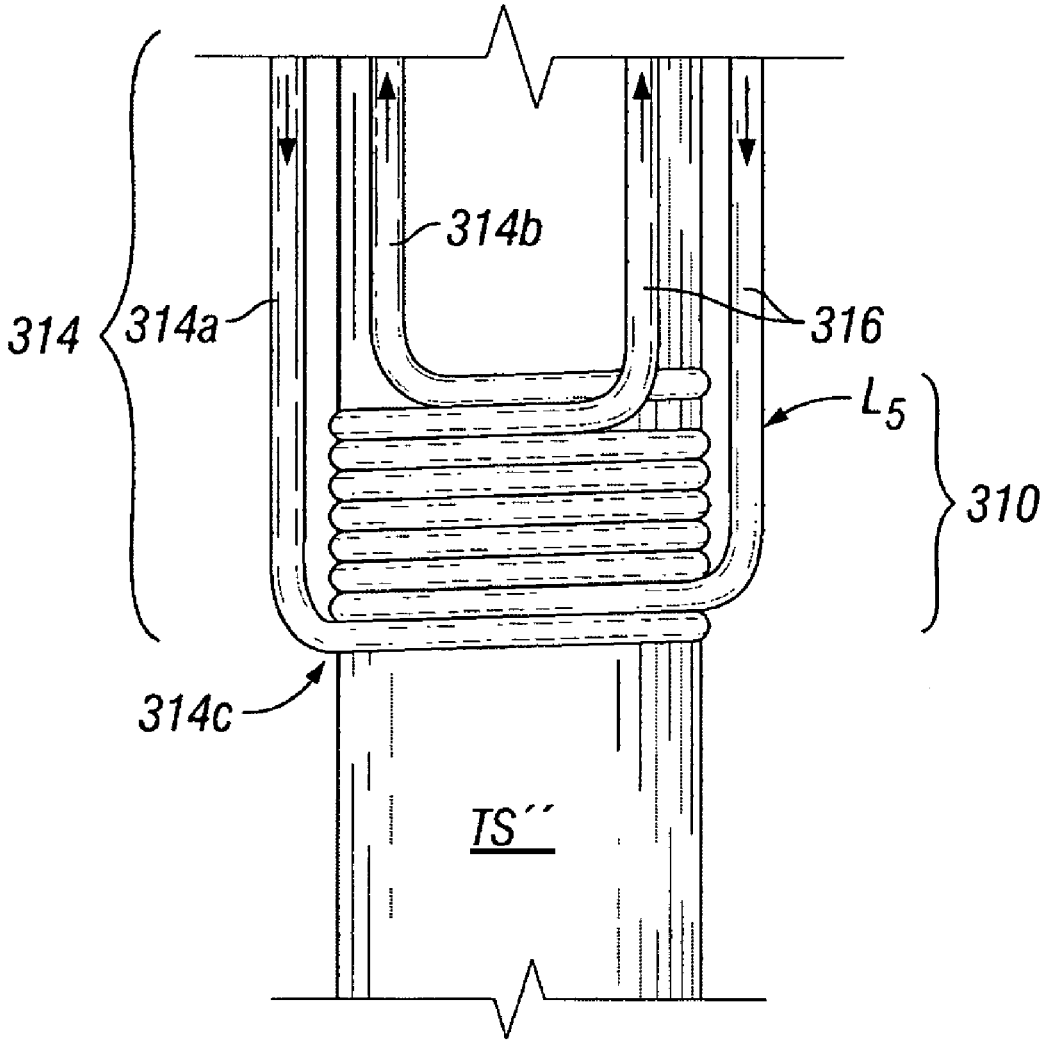
FIG. 3 is a detailed representation of one embodiment of a temperature-perturbing means and a temperature sensor according to the present invention.

FIG. 3 is a detailed representation of a portion of the tubing string TS" like the tubing strings TS and TS' shown in FIGS. 1 and 2, respectively, equipped with one embodiment of a temperature-perturbing means and a temperature sensor according to the present invention. More particularly, one or more joints of the tubing string TS" is equipped with a generally U-shaped transmission conduit 314 that includes a coiled portion wrapped around a reduced-diameter length of the tubing joint (preferably at a mandrel portion of the joint). Conduit 314 is characterized by a smaller diameter branch 314*a* for delivering a suitable cooling gas, such as nitrogen or carbon dioxide, downhole along the tubing string TS", a larger diameter branch 314*b* for returning the transmitted cooling gas back to the surface, and a transition region 314*c* that undergoes an expansion from the smaller diameter of branch 314*a* to the larger diameter of branch 314*b* to effect a cooling of the transmitted gas in situ. Thus, in the embodiment depicted in FIG. 3, the temperature sink 310 resulting from the coils in larger diameter conduit branch 314*b* constitutes a heat sink for effecting a drop in the temperature of the location of interest $L_5$, thereby inducing a temperature transient in accordance with the present invention. It will be appreciated by those having ordinary skill in the art that the gas flow could easily be reversed so as to transition from the larger diameter conduit branch 314*b* to the smaller diameter conduit branch 314*a*, thereby constituting a cold sink for effecting a rise in the temperature of the location of interest $L_5$.

With reference again to FIG. 3, the illustrated joint of the tubing string TS" is further equipped with a generally U-shaped, conduit for routing optical fibers therein between surface electronics (like electronics 118 and 218 described above with reference to FIGS. 1 and 2) and the location of interest $L_5$, with the routing conduit constituting—along with the optical fibers—part of a communication link 316 that includes a coiled portion wrapped around the reduced-diameter length of the tubing joint. The optical fibers may be equipped with a fiber optic-based temperature sensor (not shown) that is deployed in the communication link 316 at or near the location of interest $L_5$ for a purpose that will be described below. The temperature sensor may be a conventional sensor or a customized instrument having appropriate measurement performance, as will be apparent to those having ordinary skill in the art. The temperature sensor may be used with appropriate data acquisition and signal processing means, as are also known to those skilled in the art.

In the embodiment of FIG. 3 (as well as some others described herein), a temperature sensing conduit 316 and a temperature-perturbing conduit 314 are coiled together such that the two are in full contact with each other at the flowrate-determining location of interest $L_5$. This promotes an efficient use of the cooling or heating medium that is transmitted via the temperature-perturbing conduit to effect a measurable temperature transient via the temperature-sensing conduit and its conveyed temperature sensor.

Figure 4A:
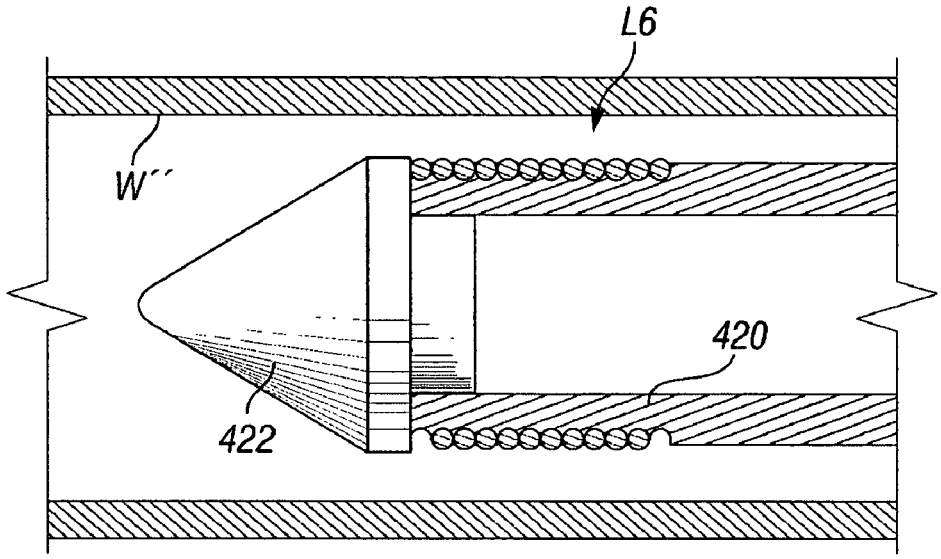
FIGS. 4A-4B are detailed sectional and isometric representations of a further embodiment of a temperature-perturbing means and a temperature sensor according to the present invention.
Figure 4B:
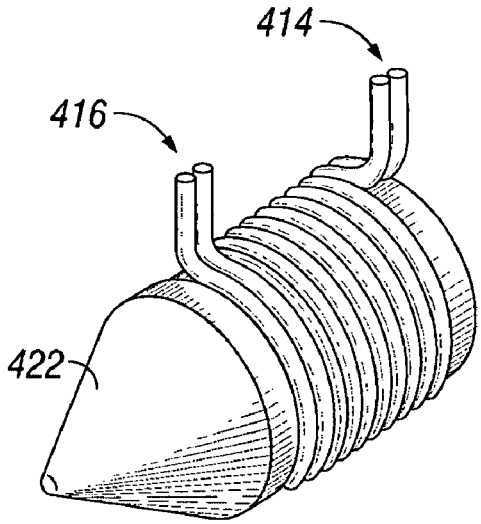

FIGS. 4A-4B are detailed sectional and isometric representations of a further embodiment of a temperature-perturbing means and a temperature sensor according to the present invention. Unlike the embodiments depicted in FIGS. 1-3, which were adapted for use with a tubing string typically having an opened end, the embodiment shown in these figures is adapted for use with a tubular "stinger" 420 having a closed conical end or nose 422. When so-equipped, the stinger 420 is adapted for placement within a wellbore W" (shown as op hole, but could be cased and/or lined) so as to be immersed in the fluid flow stream. In other words, the fluid in the wellbore W" will flow around the nose portion 422 and the stinger 420, rather than through the tubular joints that make up the stinger 420.

The stinger 420 is equipped with one embodiment of a temperature-perturbing means and a temperature sensor according to the present invention. More particularly, one or more joints of the stinger 420 is equipped with a generally U-shaped transmission conduit 414 that includes a coiled portion wrapped around a leading, reduced-diameter portion of the stinger 420. The conduit 414 (parallel branches thereof shown partially pulled away from the stinger in FIG. 4B for clarity) may be characterized by diameter changes like the conduit 314 of FIG. 3, but other known solutions for effecting a cooling or heating of a location of interest $L_6$ may also be employed so as to induce a temperature transient in accordance with the present invention.

The illustrated portion of the stinger 420 is further equipped with a generally U-shaped, conduit (parallel branches thereof shown labeled as 416 and partially pulled away from the stinger in FIG. 4B for clarity) for routing optical fibers or other, known temperature sensing means therein between surface electronics (like electronics 118 and 218 described above with reference to FIGS. 1 and 2) and the location of interest $L_6$, with the routing conduit constituting—with the optical fibers—part of a communication link 416. The optical fibers are equipped with a fiber optic-based temperature sensor that is deployed in the communication link 416 at or near the location of interest $L_6$ for a purpose that will be described below.

Figure 5A:
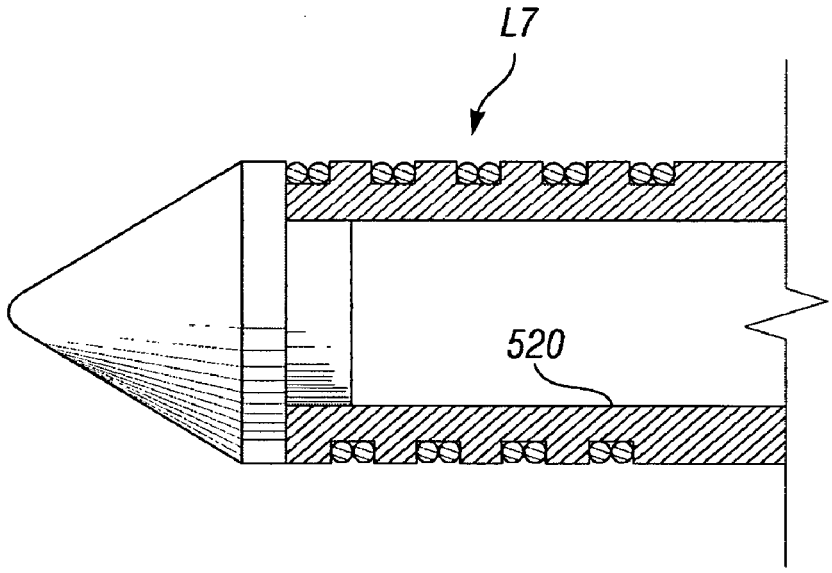
FIGS. 5A-5B are detailed sectional and isometric representations of a still further embodiment of a temperature-perturbing means and a temperature sensor according to the present invention.
Figure 5B:
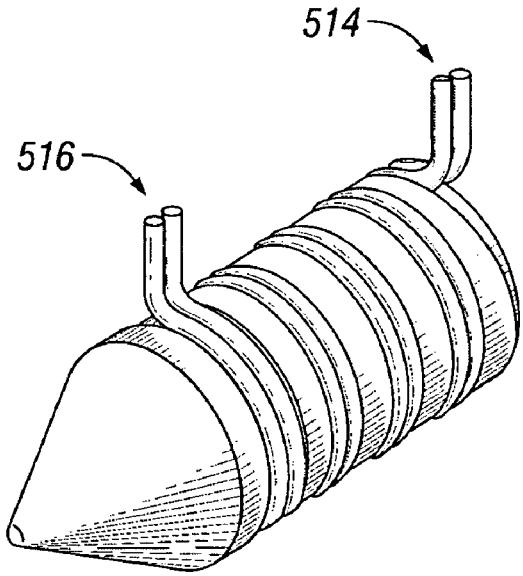

FIGS. 5A-5B are detailed sectional and isometric representations of a still further embodiment of a temperature-perturbing means and a temperature sensor according to the present invention. This embodiment is very similar to that shown in FIGS. 4A-4B. Thus, one or more joints of the stinger 520 is equipped with a generally U-shaped transmission conduit 514 that includes a coiled portion wrapped around a leading, grooved portion of the stinger 520. The conduit 514 (parallel branches thereof shown partially pulled away from the stinger in FIG. 5B for clarity) may be characterized by diameter changes like the conduit 314 of FIG. 3, but other known solutions for effecting a cooling or heating of a location of interest $L_7$ may also be employed so as to induce a temperature transient in accordance with the present invention.

The illustrated portion of the stinger 520 is further equipped with a generally U-shaped, conduit (parallel branches thereof shown labeled as 516 and partially pulled away from the stinger in FIG. 5B for clarity) for routing optical fibers or other, known temperature sensing means therein between surface electronics (like electronics 118 and 218 described above with reference to FIGS. 1 and 2) and the location of interest $L_7$, with the routing conduit constituting—along with the optical fibers—part of a communication link 516. The optical fibers are equipped with a fiber optic-based temperature sensor that is deployed in the communication link 516 at or near the location of interest $L_7$ for a purpose that will now be described.

The present invention provides, through various embodiments as described and suggested herein, a method for determining the flowrate of fluid flowing within a passage. As mentioned above, the present invention has particular application in which a fluid-flow passage is defined by a wellbore penetrating one or more subsurface earth strata. The fluid in such a passage may comprise at least one of oil, gas, water, and a combination thereof. The passage may be further defined by a conduit disposed in the wellbore, for example, by a conduit disposed in a portion of the wellbore that is substantially horizontal.

The flowrate-determining method comprises the step of measuring the equilibrium temperature of a location of interest within or proximate to the passage within which fluid flows. This may be achieved by a fiber-optic based solution as described above, but other solutions known to those having ordinary skill in the art may also be applied to advantage. Thus, for example, solutions involving the use of resistance temperature detectors (RTDs) or other thermocouple devices may be employed to measure the equilibrium temperature.

The present invention further includes the establishment of a temperature transient by perturbing the local temperature at the flowrate-determining location of interest. Accordingly, the temperature of the location of interest is pulsed or perturbed to a second temperature (other than its equilibrium temperature), and the temperature of the location of interest is then allowed to return to its equilibrium temperature. The temperature of the location of interest is monitored by the fiber-optic based sensor, or other temperature-monitoring means employed, as the temperature transitions between the second temperature and the equilibrium temperature.

As mentioned above, the temperature-perturbing step may be performed using a temperature sink, such as a heat sink (e.g., a cooled fluid) or a cold sink (e.g., a heated fluid or an electrical heater). The temperature sink may be either permanently installed (e.g., on production tubing) or inserted on a temporary carrier (e.g., a stinger), and may be substantially collocated with the temperature sensor. It will therefore be appreciated by those skilled in the art that it is not necessary to change the temperature of the fluid flowing through the passage to practice the inventive method, even though the local temperature at the location of interest experiences a transient.

The monitored temperature transition is then used to determine the flowrate of the fluid flowing within the passage, such as, for example, by correlating the monitored temperature transition to flowrate within the passage. One aspect of the present invention relates to the discovery that the time required for the temperature of the location of interest to transition halfway between the second temperature and the equilibrium temperature defines a temperature relaxation half-life that may be correlated to flowrate within the passage. In particular embodiments of the inventive method, interpretive models such as Computational Fluid Dynamics (CFD) models are employed to correlate the monitored temperature transition to flowrate within the passage.

Figure 6:
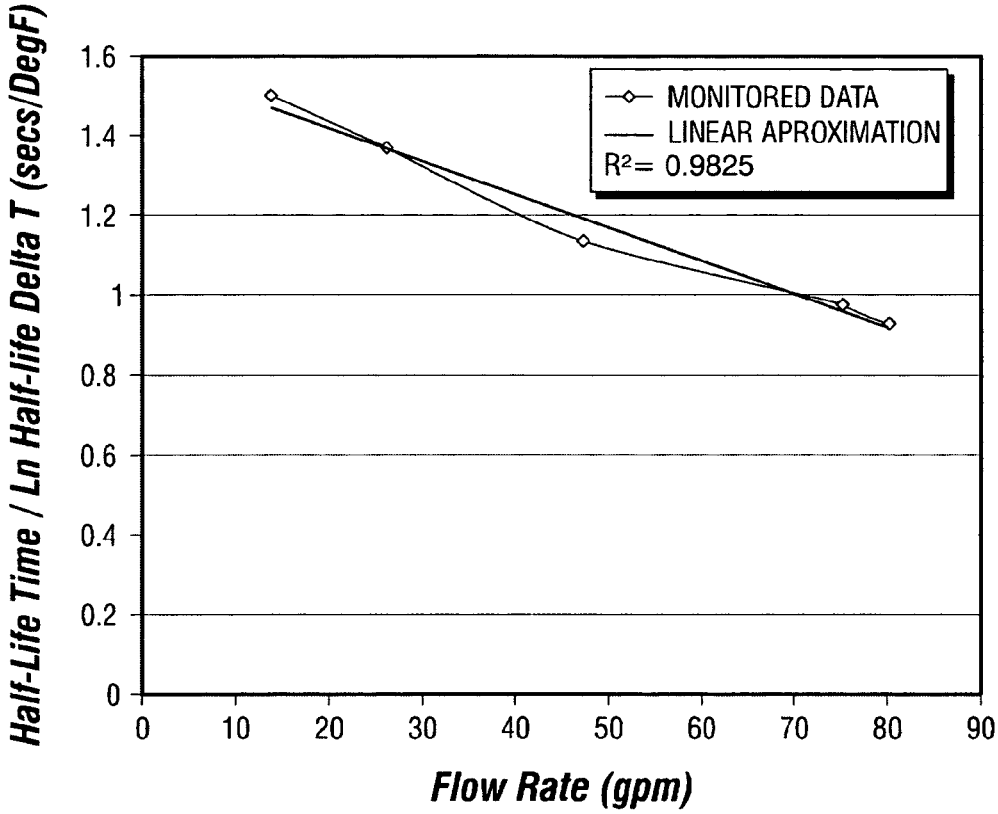
FIG. 6 is a graphical correlation between temperature relaxation half-life and flowrate within a passage according to the present invention.

FIG. 6 is a graphical representation of a linear correlation between temperature relaxation half-life and flowrate within a wellbore passage according to the present invention. The graph represents data monitored over a 15-second cooling transition between a perturbed temperature and an equilibrium temperature. The monitored data for linear regression ($R^2$) is 0.9825, indicating that 98.25% of the variation of corresponding fluid flowrate is accounted for by the natural log temperature relaxation half-life (i.e., the monitored temperature delta and its time).

In the case of wellbore flow of a formation-produced fluid, the fluid's temperature is influenced by: (a) the temperature of the subsurface formation or zone from which the fluid is recovered; (b) the temperature of the subsurface formation or zone(s) through which the fluid passes before it encounters the temperature sensor of the invention; and (c) the time required for the fluid to reach the temperature sensor after it enters the wellbore bore. By using the temperature relaxation half-life to determine fluid flowrate, many of the local effects of the wellbore passage, including type and size of the wellbore, flowrate-determining location within the wellbore, characteristics of the specific produced fluid, among others that may complicate flowrate determination, are minimized or eliminated. Further benefits of such a correlation relate to its independence of how long the temperature perturbation (e.g., cooling fluid) is applied, to what magnitude the perturbation is applied (e.g., volume of cooling fluid), and even the effectiveness of the perturbation (e.g., cooling fluid thermal properties).

Empirical data have indicated that a mass flowrate can be accurately derived solely from a temperature relaxation correlation of the type that is shown in FIG. 6. Additional information may be derived if the temperature relaxation profile is analyzed using a more detailed, first-principles approach to the relaxation dynamics. For example, the inventive method may further be useful for determining the composition of two-phase and three-phase production fluids, including the oil/water and oil/water/gas ratios.

It will be further appreciated that the inventive method is useful for developing a production profile for a horizontal wellbore, showing the specific volume of oil production along the length of the horizontal wellbore bore. The inventive method is also similarly useful for determining the mass flow volume of produced oil from one or more specific producing formations or zones which are penetrated by a common wellbore.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A," "an" and other singular terms are intended to include the plural forms thereof unless specifically excluded.

What is claimed is:

1. A method for determining the flowrate of fluid flowing within a passage, comprising the steps of:

measuring the equilibrium temperature of a location of interest within or proximate to the passage within which fluid flows;

perturbing the temperature of the location of interest to a second temperature;

allowing the temperature of the location of interest to return to the equilibrium temperature;

monitoring the temperature of the location of interest as it transitions between the second temperature and the equilibrium temperature; and using the monitored temperature transition to determine the flowrate of the fluid flowing within the passage.

2. The method of claim 1, wherein:

a temperature sensor is positioned at the location of interest for performing the measuring and monitoring steps.

3. The method of claim 2, wherein the temperature sensor comprises an optical fiber.

4. The method of claim 2, wherein the perturbing step is performed using a heat sink.

5. The method of claim 4, wherein the perturbing step is performed using a heat sink substantially collocated with the temperature sensor.

6. The method of claim 2, wherein the perturbing step is performed using a cold sink.

7. The method of claim 6, wherein the perturbing step is performed using a cold sink positioned substantially collocated with the temperature sensor.

8. The method of claim 1, wherein the passage is defined by a wellbore penetrating one or more subsurface earth strata.

9. The method of claim 3, wherein the flowing fluid comprises at least one of oil, gas, water, and a combination thereof.

10. The method of claim 3, wherein the passage is defined by a conduit disposed in the wellbore.

11. The method of claim 10, wherein the conduit is disposed in a portion of the wellbore that is substantially horizontal.

12. The method of claim 1, wherein the using step comprises correlating the monitored temperature transition to flowrate within the passage.

13. The method of claim 12, wherein the time required for the temperature of the location of interest to transition halfway between the second temperature and the equilibrium temperature defines a temperature relaxation half-life that may be correlated to flowrate within the passage.

14. The method of claim 13, wherein the correlation between temperature relaxation half-life and flowrate within the passage is substantially linear.

15. An apparatus for determining the flowrate of hydrocarbon fluids flowing within a portion of a wellbore penetrating a subsurface stratum of interest, comprising:

a means comprising a temperature sink positionable at or near a location of interest within the wellbore for perturbing the temperature of the location of interest; and a temperature sensor positionable at or near the location of interest.

16. The apparatus of claim 15, wherein the temperature-perturbing means is controllable from a surface location to perturb the temperature of the location of interest to a temperature other than the equilibrium temperature at the location of interest.

17. The apparatus of claim 15, wherein the temperature sink and the temperature sensor are integrated within a single unit.

18. The apparatus of claim 15, wherein the temperature sink and the temperature sensor are installed separately within the wellbore bore.

19. The apparatus of claim 15, wherein the temperature sink comprises a heat sink.

20. The apparatus of claim 19, wherein the temperature-perturbing means comprises a conduit through which a cooling medium is transmitted.

21. The apparatus of claim 15, wherein the temperature sink comprises a cold sink.

22. The apparatus of claim 21, wherein the temperature-perturbing means comprises a conduit through which a heating medium is transmitted.

* * * * *